United States Patent [19]

Skelton

[11] 4,049,275

[45] Sept. 20, 1977

[54] BOARD GAME APPARATUS

[76] Inventor: Carl W. Skelton, 1105 Running Brook Drive, Shreveport, La. 71108

[21] Appl. No.: 725,848

[22] Filed: Sept. 23, 1976

[51] Int. Cl.[2] ..... A63F 3/00

[52] U.S. Cl. ..... 273/134 AE; 273/1 M

[58] Field of Search ..... 273/1, 131, 134

[56] References Cited

U.S. PATENT DOCUMENTS

| | | | |
|---|---|---|---|
| 2,463,795 | 3/1949 | Neuzerling | 273/1 M UX |
| 2,716,028 | 8/1955 | Yaeger | 273/1 M UX |
| 3,781,015 | 12/1973 | Ellman et al. | 273/1 M X |

*Primary Examiner*—Delbert B. Lowe
*Attorney, Agent, or Firm*—John M. Harrison

[57] ABSTRACT

A board game apparatus for use in a game of chance which includes a game board having a playing surface characterized by a flat area with outer and inner tracks for traversal by a player or game token according to the throws of dice. The game tokens are magnetically influenced and successful traversal of the game tokens depends in part on chance expulsion from selected track positions by a magnet-equipped stick in the possession of each player.

10 Claims, 5 Drawing Figures

BOARD GAME APPARATUS

BACKGROUND OF THE INVENTION

1. Field of the Invention

This invention relates to board games, and more particularly to board games characterized by the traversal of game board by player or game tokens according to the throws of a die or dice. The board game apparatus of this invention combines the usual element of chance in traversing the game board from a start to a finish location for each player with an additional element of chance by providing a method of magnetically influencing the game tokens at specific points on the game board tracks to affect the rate of traversal of the tokens on the tracks. The game may be played with two or more players and the game board shaped to accommodate the number of players desired.

2. Description of the Prior Art

Board games have long been popular with persons of all ages and backgrounds, and are particularly popular with children and those who enjoy parlor games. Particularly popular are games characterized by application of the element of chance to the traversing of a game board according to established rules of play. One of the most intriguing and popular of the board games is that disclosed in U.S. Pat. No. 2,026,082, entitled "Game Board Apparatus" and known the world over as "Monopoly". Board games generally combine one or more elements of skill with the element of chance to provide an exciting and absorbing pastime for persons of all ages.

Accordingly, it is an object of this invention to provide a board game which combines a first element of chance in traversing a game board by means of game tokens according to the throws of dice or alternative means, with a second element of chance involving a risk of losing the territory traversed by the influence of a magnet-equipped stick upon coincidence of the game token and the stick at certain locations on the game board track.

Another object of the invention is to provide a board game which utilizes a game board designed and shaped to accommodate players at specific locations adjacent points on the periphery of the game board, and which is capable of accommodating at least two players.

Yet another object of this invention is to provide a game board apparatus which includes a game board having a magnetically sensitive track or tracks for chance traversal of magnet-containing game tokens, and a plurality of challenge sticks equipped with magnets at one end for insertion in slots in the game board at designated points to permit coincidence of the magnet-equipped ends of the challenge sticks with the game tokens at specific track locations, to affect token traversal from start to finish on the track.

Yet another object of the invention is to provide a game board apparatus which can be used to effect traversal of magnetized player tokens along specified game board track locations according to the throws of a die or dice, and which permits chance influence of the tokens by other tokens, or by insertion of magnet-equipped challenge sticks in game board slots in the proximity of the tokens at specified track locations or spaces, with the resulting attracting or repelling influence of the magnets determining a course of future movement of the token or tokens.

SUMMARY OF THE INVENTION

These and other objects of the invention are provided in a game board apparatus which is characterized by a game board having an outer and inner track on the playing surface, and several slots provided in the game board, which slots communicate with specific "danger" track locations on the board playing surface. The outer and inner tracks are traversed by magnet-equipped game or player tokens according to chance determined by the throws of a die or dice, and coincidence of a token with a "danger" track location subjects the token to a chance hazard of being repelled by a magnet located in a challenge stick and inserted in an appropriate slot running under the "danger" track location and the token. In like manner, players can "challenge" each other as the game tokens traverse the tracks at any track location where two tokens happen to coincide at any given throw of the die or dice.

BRIEF DESCRIPTION OF THE DRAWING

The invention will be better understood in view of the following description presented with reference to the accompanying drawing.

DESCRIPTION OF THE PREFERRED EMBODIMENTS

Figure 1:
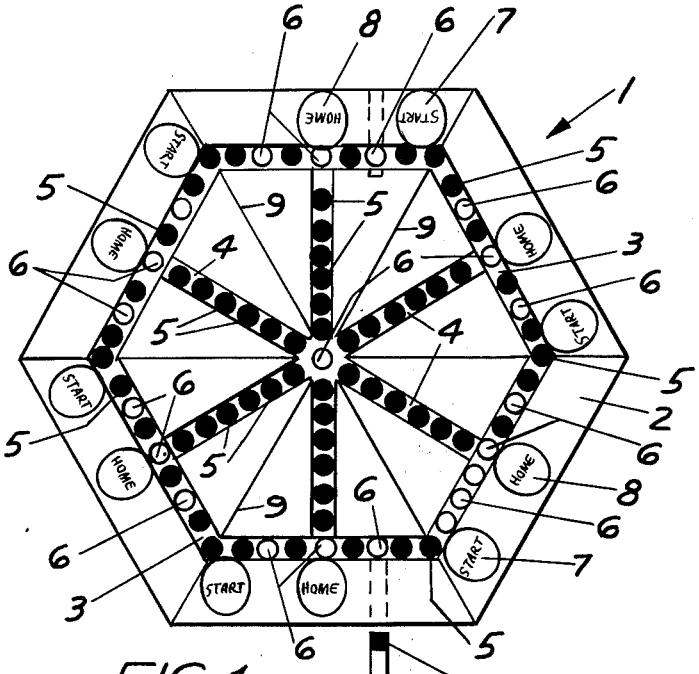
FIG. 1 of the drawing is a top elevation of the game board of this invention.
Figure 2:
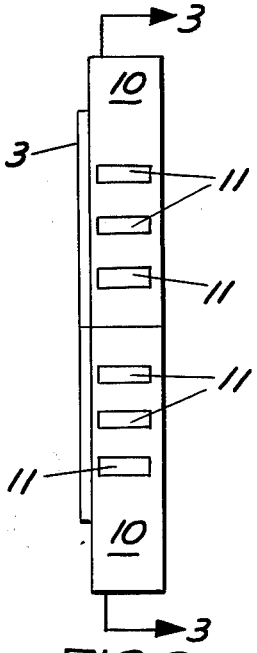
FIG. 2 is a right side elevation of the game board illustrated in FIG. 1.

Referring now to FIGS. 1 and 2 of the drawing, the game board of this invention is generally illustrated by reference numeral 1. Game board 1 includes playing surface 2 with outer track 3 and inner track 4 preferably overlayed on playing surface 2. Outer track 3 and inner track 4 may alternatively be formed integrally with game board 1 and playing surface 2, and are provided with a plurality of safe spaces or locations 5 and danger spaces or locations 6. Traversal of outer track 3 and inner track 4 by player tokens 17 (illustrated in FIG. 4) is effected by moving to successive and adjacent safe spaces 5, and successive and adjacent safe spaces 5 and danger spaces 6, by chance according to the throws of a die or dice, the spinning of a dial, or by alternative chance means, as desired. The traversal of game board 1 by each one of player tokens 17 begins at each respective player start location 7, designated "START" on playing surface 2 of game board 1 and proceeds along successive and adjacent safe spaces 5 and danger spaces 6 on outer track 3 and inner track 4 according to a prescribed route until a player token reaches a finish location 8, designated "HOME" on game board 1. In one embodiment, each player must begin at his or her respective start location 7 and finish at his or her respective adjacent finish location 8, although it will be recognized that other prescribed beginning and termination sequences can be used, as desired. In a preferred embodiment of the invention, each respective start location 7 and finish location 8 is positioned in a wedgeshaped area outlined on playing surface 2 and defined by player dividing lines 9.

Figure 3:
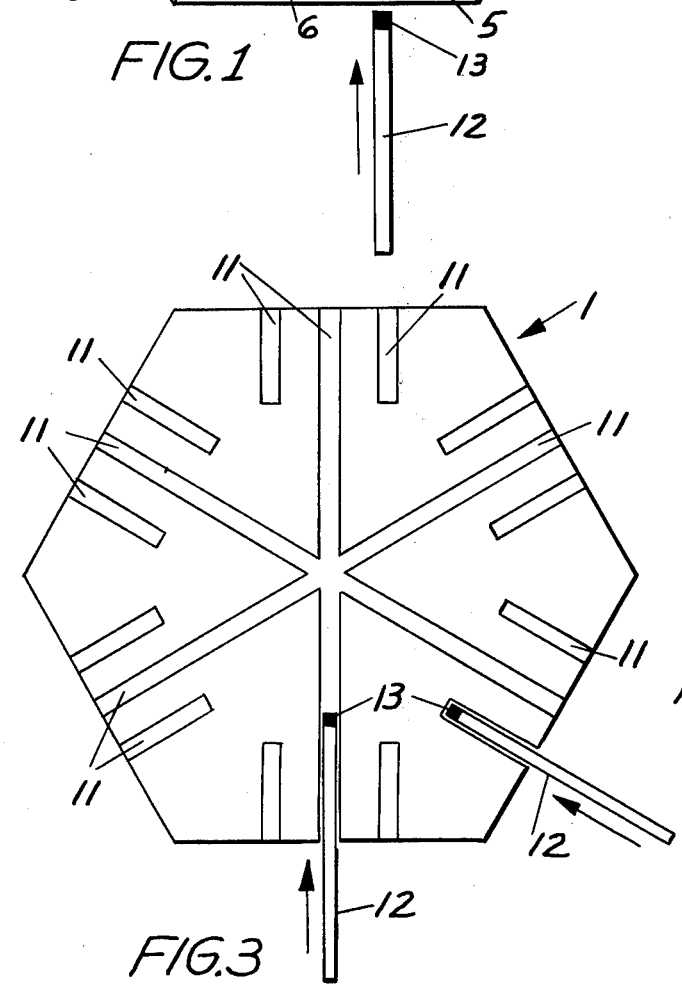
FIG. 3 is a top sectional view of the game board illustrated in FIGS. 1 and 2 along lines 3—3 in FIG. 2.
Figure 4:
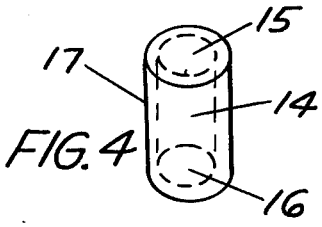
FIG. 4 is a perspective view of a typical player or game token used to traverse the game board illustrated in FIGS. 1–3 of the drawing.
Figure 5:
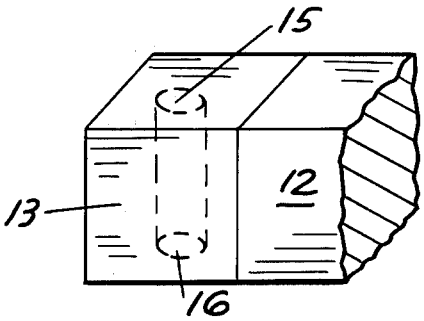
FIG. 5 is a perspective view, partially in section, of the magnet-equipped end of a challenge stick illustrated in FIGS. 1 and 3 of the drawing.

Referring now specifically to FIGS. 2 and 3 of the drawing, game board edges 10 are illustrated and are provided with slots 11. Three such slots 11 are preferably provided in each one of game board edges 10, and the middle slots 11 run through the entire diameter of game board 1 to join opposing game board edges. Each of the middle slots 11 therefore communicate in the center of game board 1, while the adjacent side slots 11 terminate just beyond the inside edge of outer track 3, as illustrated in FIGS. 1 and 3. Referring to FIGS. 1 and 3 of the drawing, slots 11 are each sufficiently large to slidably accommodate one of challenge sticks 12, and are located immediately beneath each of the respective danger spaces 6 in perpendicular relationship to game board edges 10. Challenge sticks 12 are each equipped with a magnet 14 at one end 13, as illustrated in FIG. 5 of the drawing. Magnet 14 is characterized by a south pole 15 and a north pole 16, and is preferably oriented in one end 13 of each of the challenge sticks 12, as shown. In like manner, a magnet 14 having a south pole 15 and a north pole 16 is mounted in each one of player tokens 17, and is preferably oriented as illustrated in FIG. 4 of the drawing. It is significant that player tokens 17 and challenge sticks 12 are designed such that each magnet 14 embedded therein is hidden, and the players are unable to visually discern which end of player tokens 17 and which side of challenge sticks 12 correspond to south pole 15 and north pole 16 of magnet 14. The end 13 of each of the challenge sticks 12 is marked to identify the end containing magnet 14 in order that end 13 may always be inserted in slots 11, as hereinafter described.

The board game apparatus of this invention is used as follows: A desired number of players is first selected and positioned around game board 1 such that each player is opposite one of game board edges 10. Each player is then supplied with at least one each of player tokens 17 and one of challenge sticks 12, the latter of which may be color coded for identification purposes. Each player territory may be likewise color coded and is defined by player dividing lines 9 and by the appropriate game board edge adjacent that player. The die or dice are then rolled to determine which player goes first, and all players then place their respective player tokens 17 on their respective start locations 7. When the order of procession is determined, the traversing of outer track 3 and inner track 4 according to prescribed rules of play is initiated, with the number of safe spaces 5 and danger spaces 6 traversed by each player being determined in turn by his cast of the die or dice.

The objective of the game for each player is to traverse outer track 3 and/or inner track 4 according to a preselected pattern and prescribed rules, and return his respective player token or tokens to a designated finish location 8 (HOME) first. If in the course of traversing outer track 3 and/or inner track 4 one of the player tokens 17 terminates on one of the danger spaces 6 for any given roll of the die or dice, that player may be challenged by the player who controls the territory in which the specific danger space is located. The challenging player may then complete his challenge by inserting his assigned challenge stick (with end 13 forward) into the appropriate one of slots 11 communicating with the danger space accommodating the challenged player token, and if the challenged token is repelled, the player controlling that token must take the token back to his start location 7. However, if the challenged player token is attracted to end 13 of the inserted challenge stick the challenge is nullified, and the challenged player is permitted to keep his token in this danger space until his next turn.

Similarly, in the event two player tokens are caused to occupy a single one of safe spaces 5 or danger spaces 6 by any cast of the die or dice, the player whose token is entitled to move into the occupied space must challenge the occupant player. This is accomplished by placing the challenging token on top of the occupant player token and ascertaining whether the tokens attract or repel each other by the action of each magnet 14. If the player tokens repel each other, the challenging player must return his token to his start location 7. However, if the tokens attract each other, the challenged player must remove his token from the challenged space and place it at his respective start location 7. It will be appreciated that the specific routes selected for traversing outer track 3 and inner track 4, as well as the rules prescribed for such traversal, are a matter of choice on the part of the players.

Referring again to FIG. 1 of the drawing, it will also be appreciated that game board 1 may be shaped in substantially any form to accommodate a desired number of players. For example, the preferred hexagon configuration illustrated is suitable for any number of players from two to six, with each player facing game board 1 at a specific side of the game board, and controlling at least one territory area. In like manner, game board 1 can be shaped in the form of a circle, a triangle, square, pentagon, octagon or other polygonal or multiple sided shaped in order to accommodate a selected number of players, as desired. In the case of a circular game board slots 11 are grouped in spaced relationship around the circumference of the board to provide access for challenge sticks 12. In like manner, any number of slots 11 may also be provided depending upon the number of danger spaces 6 desired.

It will be further appreciated that it is preferred to form outer track 3 and inner track 4 of a magnetically sensitive metal such as steel in order to magnetically stabilize player tokens 17 as safe spaces 5 and danger spaces 6 are traversed. Furthermore, when metal tracks are utilized, danger spaces 6 are provided with a hole or with a non-ferrous bottom portion in order to permit appropriate magnetic influence between the magnets 14 in player tokens 17 and the magnets 14 embedded in end 13 of each of challenge sticks 12. Danger spaces 6 may also be provided with a collar or rim in order to keep player tokens 17 in position on the spaces, as desired.

It will be apparent that the time required for any given player to cause his token to traverse outer track 3 and/or inner track 4 of playing surface 2 in the prescribed manner and to therefore win the game can be increased by allotting more than one playing token to each player. In this manner and by regulating the particular path which players may use to traverse outer track 3 and inner track 4, the time of effecting a winning traversal can be regulated to suit the players.

Having described my invention with the particularity set forth above, what is claimed is:

1. A board game apparatus comprising:

a. a game board having marked spaces constituting a track extending about said game board to define a prescribed route of traversal of said game board;

b. at least one slot in said game board beneath selected ones of said marked spaces on said game board;

c. a plurality of player tokens, each containing a magnet, for traversing said path or track; and d. a plurality of challenge sticks, each containing a magnet in one end thereof, for insertion in said at least one slot for magnetically influencing said magnet in said player tokens when said player tokens are on said selected ones of said marked spaces.

2. The board game apparatus of claim 1 wherein:

a. said game board is characterized by a flat playing surface and is fashioned in the shape of a polygon; and b. said at least one slot is three slots provided in each side of said game board and parallel to said flat playing surface.

3. The board game apparatus of claim 1 wherein said track is formed of a magnetically sensitive metal overlay and further includes an outer track and an inner track.

4. The board game apparatus of claim 1 wherein:

a. said game board is characterized by a flat playing surface and is fashioned in the shape of a polygon;

b. said at least one slot is three slots provided in each side of said game board and parallel to said flat playing surface; and c. said track is formed of a magnetically sensitive metal overlay and further includes an outer track and an inner track.

5. The board game apparatus of claim 1 wherein:

a. said game board is characterized by a flat playing surface and is fashioned in the shape of a regular polygon;

b. said at least one slot is three slots provided in each side of said game board parallel to said playing surface; and c. the middle ones of said slots join opposing sides of said game board.

6. The board game apparatus of claim 1 wherein:

a. said track is a magnetically sensitive metal overlay comprising an outer track and an inner track having safe spaces and non-magnetically sensitive danger spaces thereon;

b. said game board is characterized by a flat playing surface and is fashioned in the shape of a polygon;

c. said at least one slot is three slots provided in each side of said game board and parallel to said playing surface; and d. the middle ones of said slots join opposing sides of said game board.

7. The board game apparatus of claim 1 wherein:

a. said game board is round and is characterized by a flat playing surface;

b. said at least one slot is three slots provided in groups and in spaced relationship around the circumference of said game board and parallel to said playing surface.

8. The board game apparatus of claim 1 wherein:

a. said game board is round and is characterized by a flat playing surface;

b. said at least one slot is three slots provided in groups and in spaced relationship around the circumference of said game board and parallel to said playing surface; and c. said track is magnetically sensitive metal overlay and further includes an outer track and an inner track characterized by safe spaces and non-magnetically sensitive danger spaces thereon.

9. The board game apparatus of claim 1 wherein:

a. said game board is characterized by a flat playing surface and is fashioned in the shape of a regular polygon having an even number of sides;

b. said at least one slot is three slots provided in each of said sides of said game board and parallel to said playing surface, the middle ones of said slots joining opposing ones of said sides and meeting at the center of said game board; and c. said track is a magnetically sensitive metal overlay comprising an outer track and an inner track characterized by safe spaces and non-magnetically sensitive danger spaces thereon.

10. The board game apparatus of claim 1 wherein:

a. said game board is characterized by a flat playing surface and is fashioned in the shape of a regular polygon having an even number of sides;

b. said at least one slot is three slots provided in each of said sides of said game board and parallel to said playing surface, the middle ones of said slots joining opposing ones of said side and meeting at the center of said game board; and c. said track is a magnetically sensitive metal overlay comprising a first track extending around said playing surface and having legs parallel to each of said sides, and a second track perpendicular to said legs and intersecting in the center of said game board, said first track and said second track having safe spaces and non-magnetically sensitive danger spaces thereon.

* * * * *